US006354638B1

(12) United States Patent
Hoffmann

(10) Patent No.: US 6,354,638 B1
(45) Date of Patent: Mar. 12, 2002

(54) BAR-SHAPED CLOSURE WITH OPERATING TRAVEL MOVING AWAY FROM THE DOOR LEAF

(75) Inventor: Rainer Hoffmann, Langenfeld (DE)

(73) Assignee: EMKA Beschlagteile GmbH & Co KG (DE)

( * ) Notice: Subject to any disclaimer, the term of this patent is extended or adjusted under 35 U.S.C. 154(b) by 0 days.

(21) Appl. No.: 09/509,596

(22) PCT Filed: Sep. 23, 1998

(86) PCT No.: PCT/DE98/02881

§ 371 Date: Mar. 24, 2000

§ 102(e) Date: Mar. 24, 2000

(87) PCT Pub. No.: WO99/16992

PCT Pub. Date: Apr. 8, 1999

(30) Foreign Application Priority Data

Sep. 26, 1997 (DE) ..... 197 42 545

(51) Int. Cl.[7] ..... E05C 9/16

(52) U.S. Cl. ..... 292/36; 292/32; 292/33; 292/336.3; 292/DIG. 31

(58) Field of Search ..... 292/32, 33, 35, 292/36, 41, 336.3, DIG. 31; 70/208, 224, DIG. 67

(56) References Cited

U.S. PATENT DOCUMENTS 4,892,338 A * 1/1990 Weinerman et al. ..... 292/35
5,419,167 A * 5/1995 Yamada et al. ..... 70/208
5,743,375 A * 4/1998 McFarland ..... 292/336.3
6,120,069 A * 9/2000 Taranto ..... 292/35
6,209,366 B1 * 4/2001 Zagoroff ..... 70/208

* cited by examiner

*Primary Examiner*—Anthony Knight
*Assistant Examiner*—Ruth C. Rodriguez
(74) *Attorney, Agent, or Firm*—R. W. Becker & Associates; R. W. Becker

(57) ABSTRACT

A bar-type closure for a door is provided. An actuating device is disposed on the outer surface of the door leaf and is rotatable between an opened and a closed position, with the rotational movement of the actuating device being convertible to longitudinal displacement of at least one locking rod that is guided parallel to the pivot axis of the door on the inner side of the door leaf thereof. The actuating device is provided with a hand lever that is pivotable outwardly about a hinge line axis oriented parallel to the pivot axis of the door and to the direction of displacement of the locking rod. The enlargement of the spacing between the hand lever and the door leaf, when the hand lever pivots, is converted into displacement of the locking rod into its release position by means of a Z-shaped drive lever that is disposed between the door leaf and the hand lever. One end of the drive lever is non-displaceably mounted in a first journal on an inner surface of the hand lever that faces the door leaf. The other end is mounted in a second journal that is displaceable relative to the door leaf. The second journal is coupled with the locking rod by means of an articulation that extends through the door leaf.

7 Claims, 3 Drawing Sheets

BAR-SHAPED CLOSURE WITH OPERATING TRAVEL MOVING AWAY FROM THE DOOR LEAF

BACKGROUND OF THE INVENTION

The invention concerns a bar-shaped closure, especially for sheet metal locker doors, comprising an actuating device on the external surface of the door leaf and rotatable between an open position and a closed position, wherein the rotational movement of the actuating device via a mechanism can be converted to longitudinal displacement of at least one locking rod on the internal side of the door leaf parallel to the door edge.

EP 0 261 267 B1 describes a bar-shaped closure with the aforesaid features. In the known bar-shaped closure the actuating device constituting, e.g., a handle, can be moved in a plane parallel to the plane of the door leaf so that the actuating device passes through the door leaf with an actuating shaft. The mechanism for converting the movement of the actuating device to a longitudinal displacement of at least one locking rod comprises a pinion that is borne rotatable in a corresponding lock case and that is driven by the rotatable actuating shaft, and the exterior teeth of the pinion engage in a corresponding recess of the locking rod. If a pivoted lever is provided for the actuating device in the known bar-shaped closure, the pivoted lever is arranged such that in its rest position it drops into a base plate and can be locked therein.

The known bar-shaped closure, especially in regard to the embodiment of the actuating device as a pivoted lever, suffers from the disadvantage that two different motions are required to release or lock the rod. Once unlocked, first the pivoted lever must be opened out of the base plate, for which purpose a spring support is generally attached, and then the pivoted lever must be moved parallel to the plane of the door leaf as a rod drive. In addition, the lock case required for the mechanism for receiving the pinion and the rod driven thereby must necessarily comprise a plurality of components and therefore must be pre-assembled, which is a complex and expensive undertaking. Finally, a special step is required for holding and attaching the lock case when the rod-shaped closure is installed on a door leaf.

The object of the invention is therefore to fabricate a bar-shaped closure with the generic features that comprises fewer individual parts, and in particular furthermore to simplify its assembly and use.

SUMMARY OF THE INVENTION

This object is achieved using the contents of the claims, including advantageous embodiments and further developments, subsequent to this specification.

The main idea for the invention is that the actuating device has a hand lever capable of pivoting by being pulled outward relative to the door leaf about a hinge line axis that is parallel to the door edge, and that a first bearing designed for one end of a Z-shaped drive lever is located fixed on the hand lever inner surface oriented towards the door leaf and the other end of the Z-drive lever is located in a second bearing capable of sliding relative to the door leaf, wherein the second bearing is coupled with the locking rod by means of an articulation passing through the door leaf. The idea for the invention thus is based on the principle of simplifying the mechanism so that the pivoting motion of the hand lever away from the plane of the door leaf, which in the prior art consists merely of opening out the lever from the base plate, is immediately converted to the longitudinal displacement of the locking rod. The mechanism required for this comprises the Z-drive lever, which when the hand lever is in its resting position is inserted at the distance required between the hand lever and door leaf. Since the drive lever at its one end is mounted on the hand lever in the fixed first bearing formed there, moving the hand lever away from the door leaf plane and thus increasing the distance bridged by the drive lever necessarily leads to a linear relative motion of the second bearing arranged on the door leaf side for the other end of the Z-drive lever. This linear relative movement of the second bearing is immediately converted to the linear displacement of the locking bar.

Thus the construction of the rod-shaped closure is advantageously simplified since the arrangement of a complex lock case is no longer necessary and furthermore the recesses in the locking rod are also no longer necessary. The actuating device can be pre-assembled with the drive lever arranged thereon so that only one pre-assembled component has to be attached to the door leaf. Finally, handling of the rod-shaped closure is simplified because the hand lever merely has to be pulled away from the door leaf plane or pressed against the door leaf in order to effect the unlocking and locking motion of the associated locking bar.

In accordance with a first exemplary embodiment of the invention it is provided that the second bearing of the drive lever is connected to a link that on the door leaf side is capable of pivoting around an axis and that at its one end has the axis and at its other end has the articulation for the locking rod, wherein the second bearing of the Z-drive lever is arranged with a lever arm effective to the axis at the link. Thus in this embodiment the linear displacement of the second bearing of the drive lever is converted to a pivoting motion of the link fixed on one side, the length of which is such that the articulation at its other end describes an essentially linear path. The displacement travel for the locking bar coupled to the link can be established by selecting the distance between the second bearing and the axis for the link, with the operating travel of the hand lever remaining the same.

Alternatively it can be provided that the second bearing of the Z-drive lever is arranged on a slide means that on the door leaf side linearly is slidable in the shift direction of the locking rod to be the carrier of the articulation for the locking bar.

Since the drive lever is displaced laterally when the hand lever is pivoted, and not just tilted in its longitudinal axis when the hand lever is pivoted, in accordance with one exemplary embodiment of the invention it is provided that the first bearing and the second bearing have a cap-shaped cup for receiving bearing spheres located at each of the ends of the Z-drive lever. This embodiment of the first and second bearings as sphere bearings ensures the necessary degree of freedom of movement for the drive lever.

In accordance with one exemplary embodiment of the invention, the actuating device is embodied as a box-shaped component that is arranged on the external surface of the door leaf and the front surface of which faces away from the door leaf and can be pivoted away as the hand lever and the back wall of which is adjacent to the door leaf and is embodied as the carrier for the slidable second bearing for the Z-drive lever arranged between the hand lever and the back wall. The advantage of this embodiment is that the box-shaped component is pre-assembled as a unit so that this box-shaped component is attached to the door leaf as a unit. In this instance the door leaf merely needs to have the slot for passing through the pin acting as the articulation, wherein the locking rod can be attached directly to this pin.

Finally, in an arrangement of two opposing slidable locking rods it can be provided that two drive levers are arranged and each locking rod is coupled to one of the drive levers that are offset 180° relative to each other.

BRIEF DESCRIPTION OF THE DRAWINGS

An exemplary embodiment of the invention is shown in the drawing, which is described in the following.

DESCRIPTION OF PREFERRED EMBODIMENTS

Figure 1:
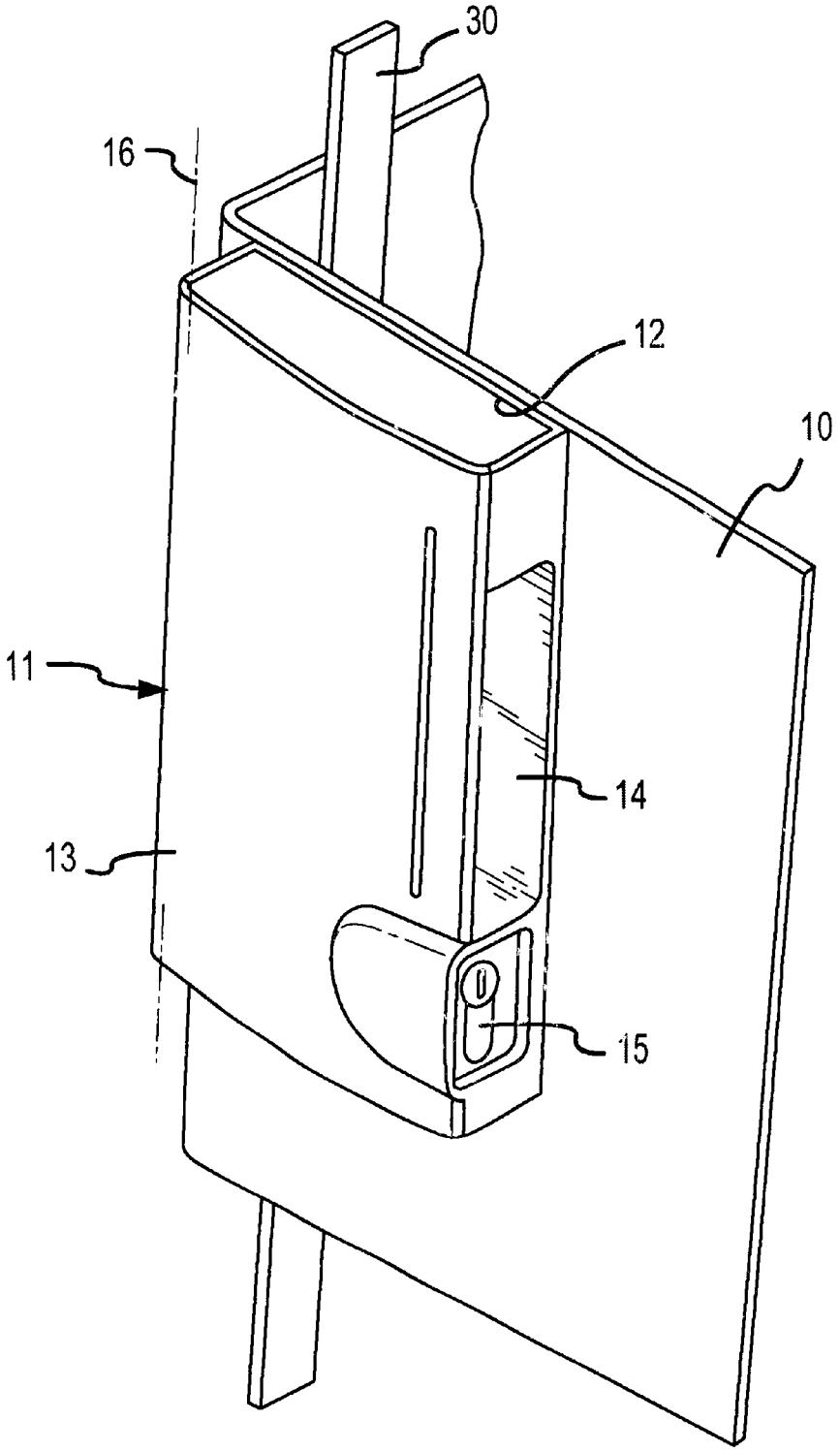
FIG. 1 is a perspective view of a bar-shaped closure to be mounted on a door leaf.

To be mounted on a door plate or leaf 10 as the main component of the bar-shaped closure is a box-shaped component 11, the back wall 12 of which is adjacent to the door leaf 10 and the front wall of which is embodied as a hand lever 13. The hand lever 13 is borne on the one side capable of pivoting away from the door leaf 10 on a hinge line axis 16 that is embodied parallel to the door leaf 10, wherein the narrow side of the component 11 opposing the hinge line axis 16 has a recessed grip 14 for gripping the hand lever 13. The hand lever 13 is lockable in a manner known per se by means of a lock 15 in the box-shaped component 11 so that the lock 15 must be unlocked prior to actuating the hand lever 13.

Figure 2A:
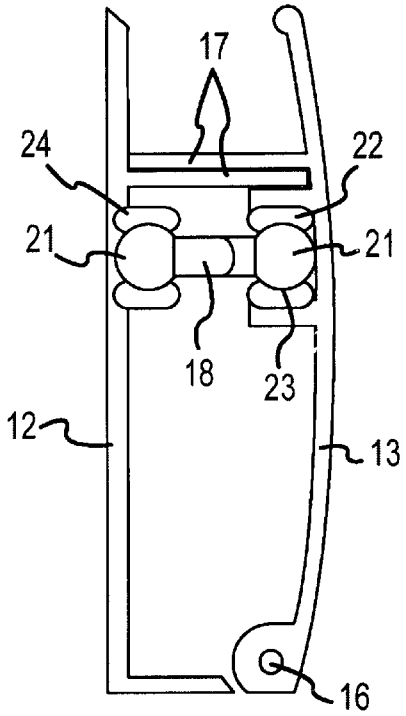
FIG. 2*a* is a top view of the hand lever with attached mechanism with locked bar-shaped closure in its closed position.
Figure 2B:
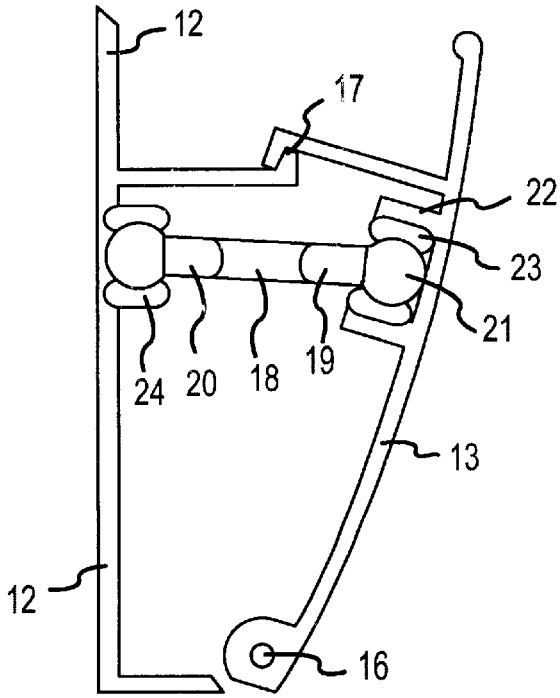
FIG. 2*b* is the subject of FIG. 2*a* with the hand lever in the open position.
Figure 3:
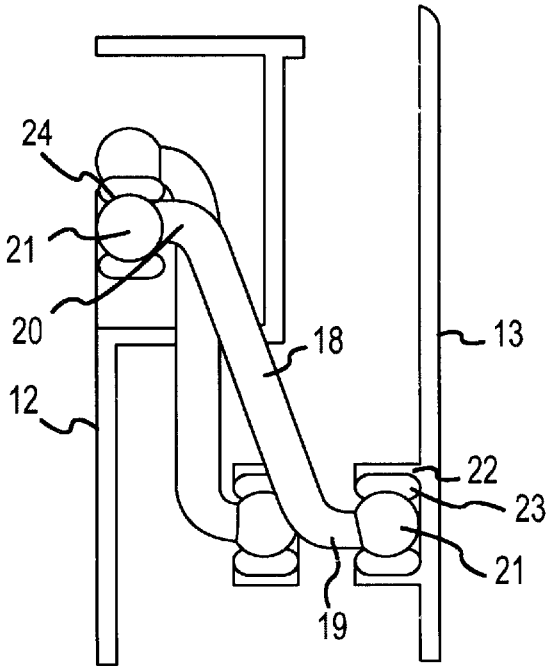
FIG. 3 is a side elevation of the subject of FIGS. 2*a* and 2*b* with the hand lever in the closed and open positions.

As can be seen in detail in FIGS. 2*a*, 2*b*, and 3, the back wall 12 and hand lever 13 of the box-shaped component 11 are provided mutually engaging pins 17 to limit the travel of the hand lever 13 when it is pulled out.

An essentially Z-shaped drive or transfer lever 18 is arranged in the space between the back wall 12 and the hand lever 13, wherein its first end 19 is fixed in a fixed first journal or bearing 22 on the interior side of the hand lever 13, while its second end 20 is held in a second journal or bearing 24 in a manner that will be described. Both ends 19, 20 of the drive lever 18 have bearing spheres 21 that are held in the associated cap-shaped cups 23 of the first bearing 22 and of the second bearing 24.

Figure 4:
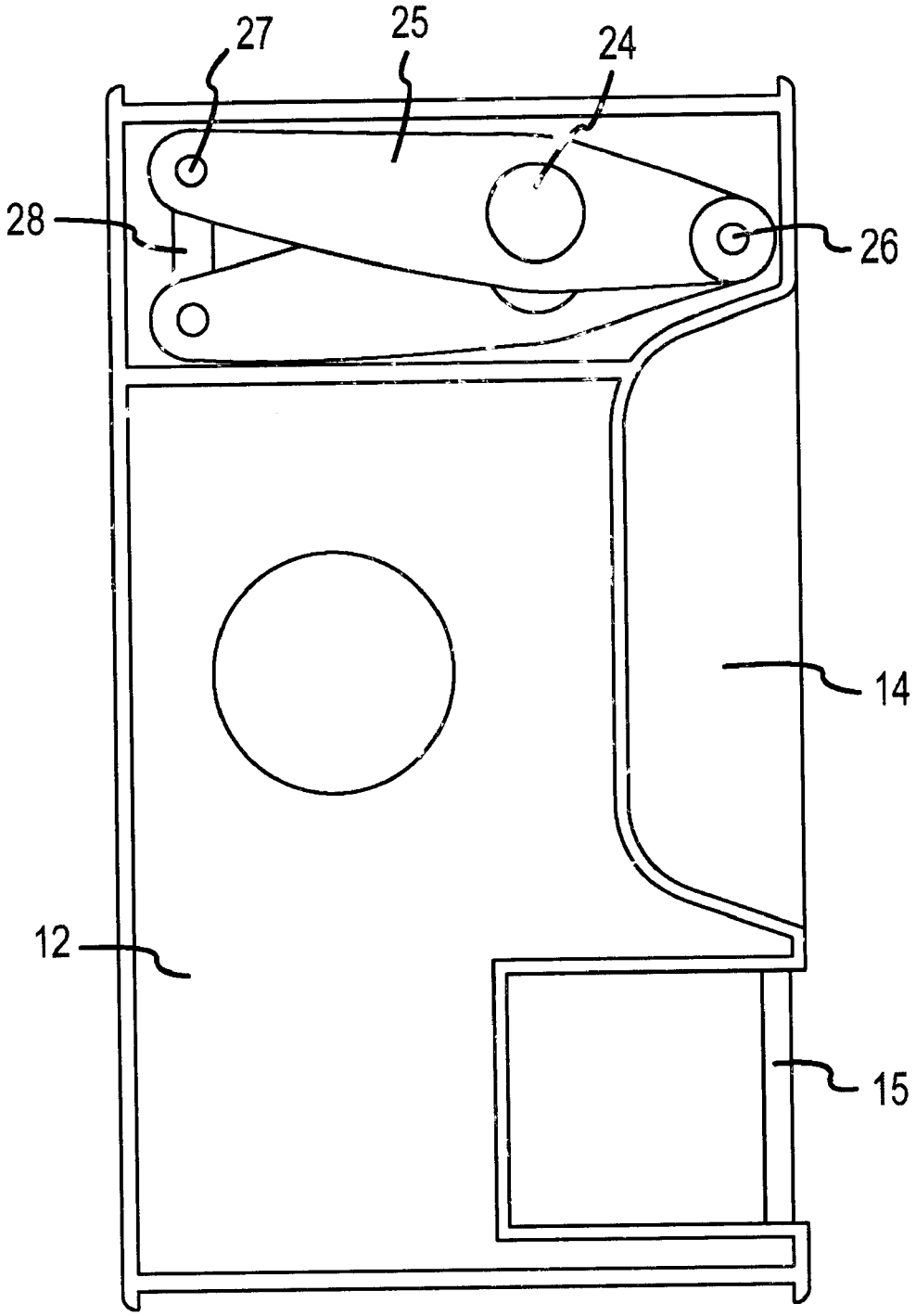
FIG. 4 is a front elevation of the link belonging to the mechanism with a bearing for the drive lever and rod articulation.

As can be seen in FIG. 4, the second bearing 24 is arranged on a link 25 borne on the back wall 12 of the box-shaped component 11 and capable of pivoting around a fixed axis 26, wherein the axis 26 is located at the one end of the link 25 while the other, opposing end of the link 25 has a pin 27 serving as articulation for a locking rod 30 guided on the interior side of the door leaf 10; the pin passes through the back wall 12 of the box-shaped component 11 in an associated slot 28 and furthermore passes through the door leaf 10 in a slot, not shown. The locking rod 30 is fixed at the end of the pin 27 projecting over the interior side of the door leaf 10.

As can be seen particularly in FIG. 3, in which are shown both the closed position of the hand lever 13 in accordance with FIG. 2*a* and the open position of the hand lever 13 in accordance with FIG. 2*b*, pulling the hand lever 13 away from the door leaf 10 and the back wall 12 of the box-shaped component leads to enlarging the distance bridged by the drive lever 18 so that, given a fixed first bearing 22 for the first end 19 of the drive lever 18, a movement of the second bearing 24 relative to the back wall 12 and door leaf 10 necessarily results. As can be seen when FIGS. 3 and 4 are studied together, this relative movement leads to the link 25 moving around its fixed axis 26, wherein the other end of the link 25 uses the pin 27 to displace the rod 30. The operating travel of the hand lever 13 when it is pulled away from the door leaf 10 and the rod travel of the locking rod 30 for the required locking and unlocking movement can be determined and/or changed by appropriate selection of the distance between the axis 26 of the link 25 and the second bearing 24 arranged on the link 25.

If the hand lever 13 is pressed back against the door leaf 10 or back wall 12 of the box-shaped component 11, the drive lever performs corresponding reverse travel so that the locking rod is returned to its locking position.

The features of the subject of this document that are disclosed in the foregoing description, in the claims, abstract, and drawings can be essential to the realization of the invention in its various embodiments, either singly or in any desired combination.

The specification incorporates by reference the disclosure of German priority documents DE 197 42 545.3 of Sep. 26, 1997 and German Patent Application priority document PCT/DE98/02881 of Sep. 23, 1998.

The present invention is, of course, in no way restricted to the specific disclosure of the specification and drawings, but also encompasses any modifications within the scope of the appended claims.

What is claimed is:

1. A bar-type closure for a door having a door leaf, comprising:

an actuating device disposed on an outer surface of said door leaf and rotatable between an open position and a closed position, wherein rotational movement of said actuating device is convertible to longitudinal displacement of at least one locking rod that is guided parallel to a pivot axis of said door on an inner side of said door leaf between a locking position and a release position wherein said actuating device is provided with a hand lever that is pivotable away from said outer surface of said door leaf about a hinge line axis thereof that is oriented parallel to said pivot axis of said door and to a direction of displacement of said at least one locking rod, wherein an increase of spacing between said hand lever and said door leaf that results with pivoting movement of said hand lever is converted into displacement of said at least one locking rod into said release position thereof by means of a Z-shaped drive lever that is disposed between said door leaf and hand lever, wherein one end of said Z-shaped drive lever is non-displaceably mounted in a first journal that is disposed on an inner surface of said hand lever that faces said door leaf, wherein a second end of said Z-shaped drive lever is mounted in a second journal that is displaceably disposed relative to said door leaf, and wherein said second journal is coupled to said at least one locking rod by means of an articulation that extends through said door leaf.

2. A bar-type closure according to claim 1 wherein said second journal of said Z-shaped drive lever is connect to a link that is pivotably disposed about a pivot axis relative to said door leaf, wherein said link is provided on one end with said pivot axis and on another end with said articulation for said at least one locking rod, and wherein said second journal is disposed on said link in such a way as to form a lever arm that is effective relative to said pivot axis.

3. A bar-type closure according to claim 1, wherein said second journal of said Z-drive lever is disposed on a slide means that relative to door leaf is linearly displaceable in a direction of displacement of said at least one locking rod and wherein said slide means forms a support for said articulation for said at least one locking rod.

4. A bar-type closure according to claim 1, wherein said first and second journals each have a cap-shaped cup for receiving respective bearing spheres disposed at each of said ends of said Z-shaped drive lever.

5. A bar-type closure according to claim 1, wherein said actuating device is embodied as a box-shaped component that is disposed on said outer surface of said door leaf, wherein a front surface of said box-shaped component that faces away from said door leaf can be pivoted away as said hand lever, and wherein a rear wall of said box-shaped component that rests against said door leaf is embodied as a support for said displaceable second journal for said Z-shaped drive lever, which is disposed between said hand lever and said rear wall.

6. A bar-type closure according to claim 1, wherein said articulation for said at least one locking rod comprises a pin that extends inwardly through a slot in said door leaf and wherein said at least one locking rod is connected to said pin.

7. A bar-type closure according to claim 1, wherein two oppositely displaceable locking rods are provided wherein two drive levers are provided, and wherein each of said locking rods is coupled to one of said drive levers, which are offset 180° relative to one another.

* * * * *